US006758654B2

(12) United States Patent
Liu

(10) Patent No.: US 6,758,654 B2
(45) Date of Patent: Jul. 6, 2004

(54) ADVERTISING CEILING FAN

(75) Inventor: Ching-Wen Liu, Taichung Hsien (TW)

(73) Assignee: Pan Air Electric Co., Ltd., Taichung Hsien (TW)

( * ) Notice: Subject to any disclaimer, the term of this patent is extended or adjusted under 35 U.S.C. 154(b) by 29 days.

(21) Appl. No.: 10/306,553

(22) Filed: Nov. 26, 2002

(65) Prior Publication Data

US 2004/0101408 A1 May 27, 2004

(51) Int. Cl.[7] ..... F04D 29/34

(52) U.S. Cl. ..... 416/146 R; 416/132 A; 416/209; 416/210 R

(58) Field of Search ..... 416/5, 61, 209, 416/210 R, 146 R, 132 A, 132 B, 244 R; 415/4.2

(56) References Cited

U.S. PATENT DOCUMENTS 831,496 A * 9/1906 Bell ..... 40/479
2,030,769 A * 2/1936 Slattengren ..... 40/479
6,193,384 B1 * 2/2001 Stein ..... 362/96

* cited by examiner

*Primary Examiner*—Edward K. Look
*Assistant Examiner*—Dwayne J. White
(74) *Attorney, Agent, or Firm*—Charles E. Baxley

(57) ABSTRACT

An advertising ceiling fan includes a motor seat, a plurality of blade support brackets, and a plurality of support tubes. Each of the blade support brackets is secured with a sleeve having two through holes. Each of the support tubes has one end formed with two positioning holes each aligning with a respective through hole. Each of the support tubes includes two elastic members each having a first end formed with a protruding stub extended through a respective one of the two positioning holes and a respective one of the two through holes. Thus, the support tube is mounted on and detached from the respective blade support bracket easily and conveniently, thereby facilitating quick replacement of the advertising paper.

7 Claims, 7 Drawing Sheets

ADVERTISING CEILING FAN

BACKGROUND OF THE INVENTION

1. Field of the Invention

The present invention relates to an advertising ceiling fan, and more particularly to an advertising ceiling fan, wherein the support tube is mounted on and detached from the respective blade support bracket easily and conveniently, thereby facilitating quick replacement of the advertising paper.

2. Description of the Related Art

A conventional advertising ceiling fan in accordance with the prior art comprises a motor seat secured on the ceiling, a plurality of blade support brackets each screwed on the bottom of the motor seat by screws and each having a distal end provided with advertising paper. However, each of the blade support brackets is screwed on the bottom of the motor seat and cannot be mounted on and detached from the motor seat easily and conveniently, thereby causing inconvenience in replacement of the advertising paper.

SUMMARY OF THE INVENTION

The present invention has arisen to mitigate and/or obviate the disadvantage of the conventional advertising ceiling fan.

The primary objective of the present invention is to provide an advertising ceiling fan, wherein the support tube is mounted on and detached from the respective blade support bracket easily and conveniently, thereby facilitating quick replacement of the advertising paper.

Another objective of the present invention is to provide an advertising ceiling fan, wherein each of the elastic members has a semi-circular pressing portion urged on a periphery of the inner wall of the support tube, thereby forming an evenly distributed elastic force, and thereby preventing failure of the elastic member due to an excessively concentrated force, so as to increase the lifetime of the elastic member.

In accordance with the present invention, there is provided an advertising ceiling fan, comprising a motor seat, a plurality of blade support brackets, and a plurality of support tubes, wherein:

the motor seat includes a protruding hood having a top having a center formed with a shaft hole, and a rotation disk rotatably mounted on a bottom of the protruding hood;

each of the blade support brackets has a first end secured on a periphery of the rotation disk of the motor seat, each of the blade support brackets is secured with a sleeve which is formed with two through holes; and each of the support tubes is secured on the sleeve of a respective one of the blade support brackets, and has one end formed with two positioning holes each aligning with a respective through hole of the sleeve, each of the support tubes includes two elastic members each mounted in the first end thereof and each having a first end formed with a protruding stub extended through a respective one of the two positioning holes of the support tube and a respective one of the two through holes of the sleeve.

Further benefits and advantages of the present invention will become apparent after a careful reading of the detailed description with appropriate reference to the accompanying drawings.

DETAILED DESCRIPTION OF THE INVENTION

Figure 1:
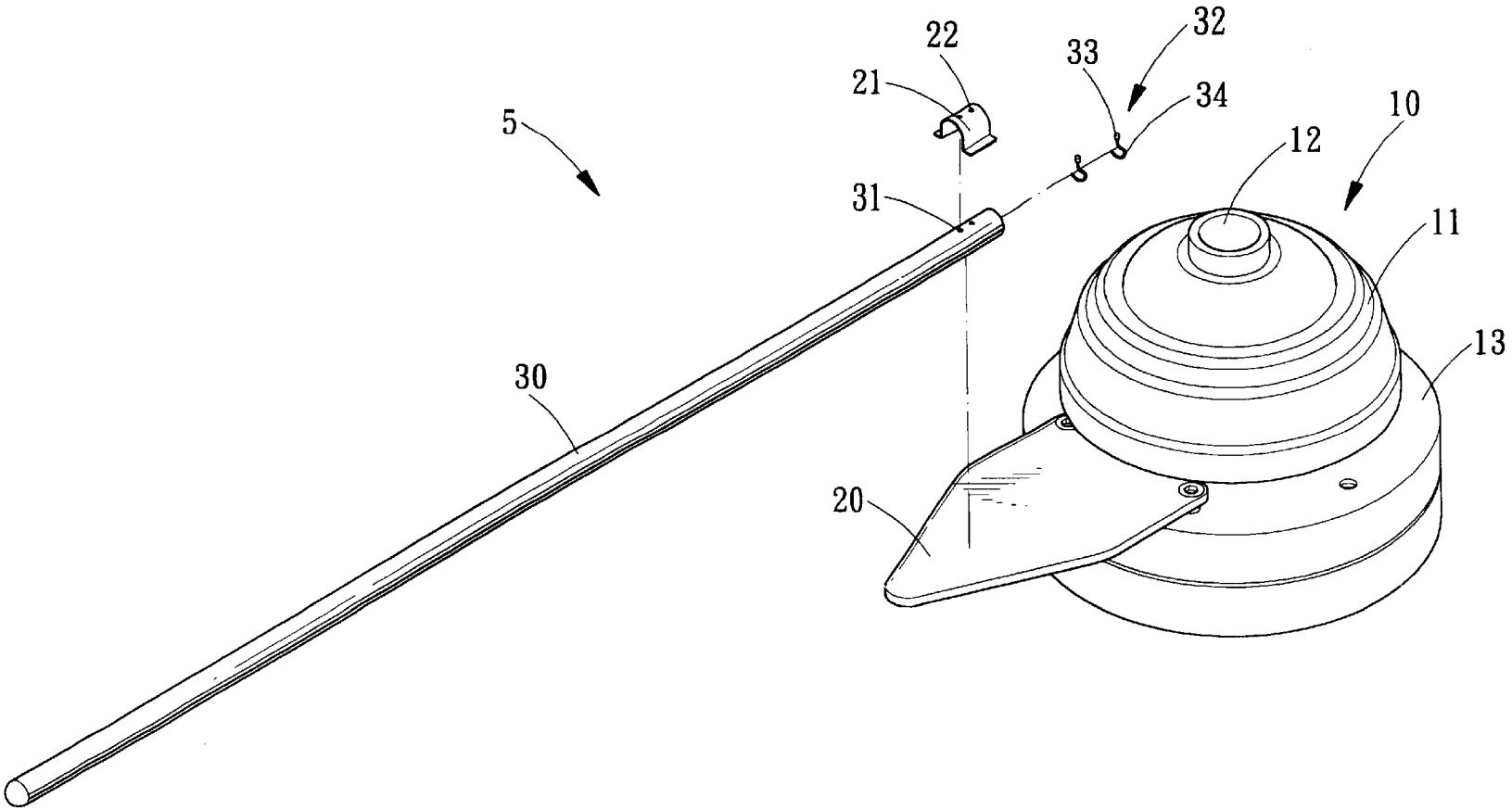
FIG. 1 is a partially exploded perspective view of an advertising ceiling fan in accordance with a first embodiment of the present invention.

Referring to the drawings and initially to FIGS. 1–5, an advertising ceiling fan 5 in accordance with a first embodiment of the present invention comprises a motor seat 10, three blade support brackets 20, and three support tubes 30.

The motor seat 10 includes a spherical protruding hood 11 having a top having a center formed with a shaft hole 12, and a rotation disk 13 rotatably mounted on a bottom of the protruding hood 11 and secured to a rotation shaft (not shown) of the motor seat 10 to rotate therewith.

Each of the three blade support brackets 20 has a first end secured on a periphery of the rotation disk 13 of the motor seat 10 and a second end having a triangular flat shape. Each of the three blade support brackets 20 is secured with a semi-circular sleeve 21 which is formed with two through holes 22.

Each of the three support tubes 30 is secured on the semi-circular sleeve 21 of a respective one of the three blade support brackets 20, and has a first end and a second end. The first end of each of the three support tubes 30 is formed with two positioning holes 31 each aligning with a respective through hole 22 of the semi-circular sleeve 21. Each of the three support tubes 30 includes two elastic members 32 each mounted in the first end thereof and each having a first end formed with a protruding stub 33 extended through a respective one of the two positioning holes 31 of the support tube 30 and a respective one of the two through holes 22 of the semi-circular sleeve 21, and a second end formed with a semi-circular pressing portion 34 urged on a periphery of the inner wall of the support tube 30 as shown in FIGS. 3 and 4, thereby forming an evenly distributed elastic force, and thereby preventing failure of the elastic member 32 due to an excessively concentrated force, so as to increase the lifetime of the elastic member 32.

Figure 2:
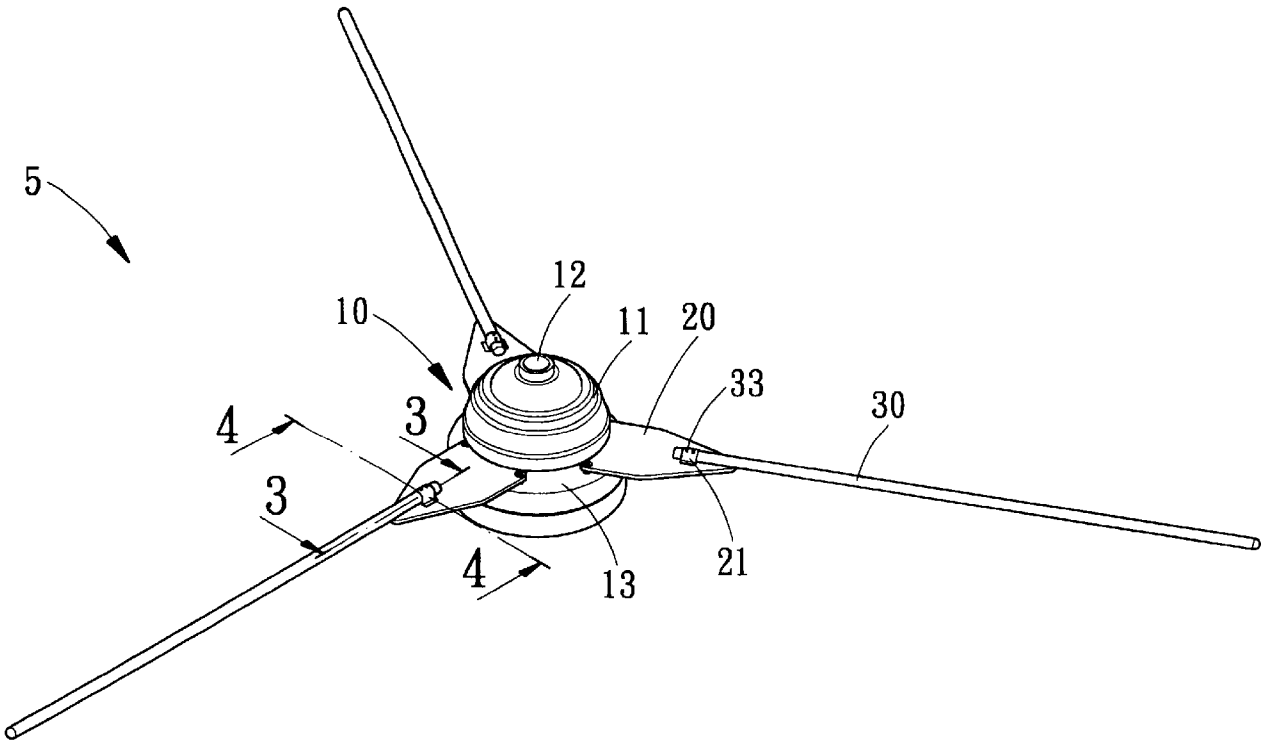
FIG. 2 is a perspective assembly view of the advertising ceiling fan in accordance with the first embodiment of the present invention.
Figure 3:
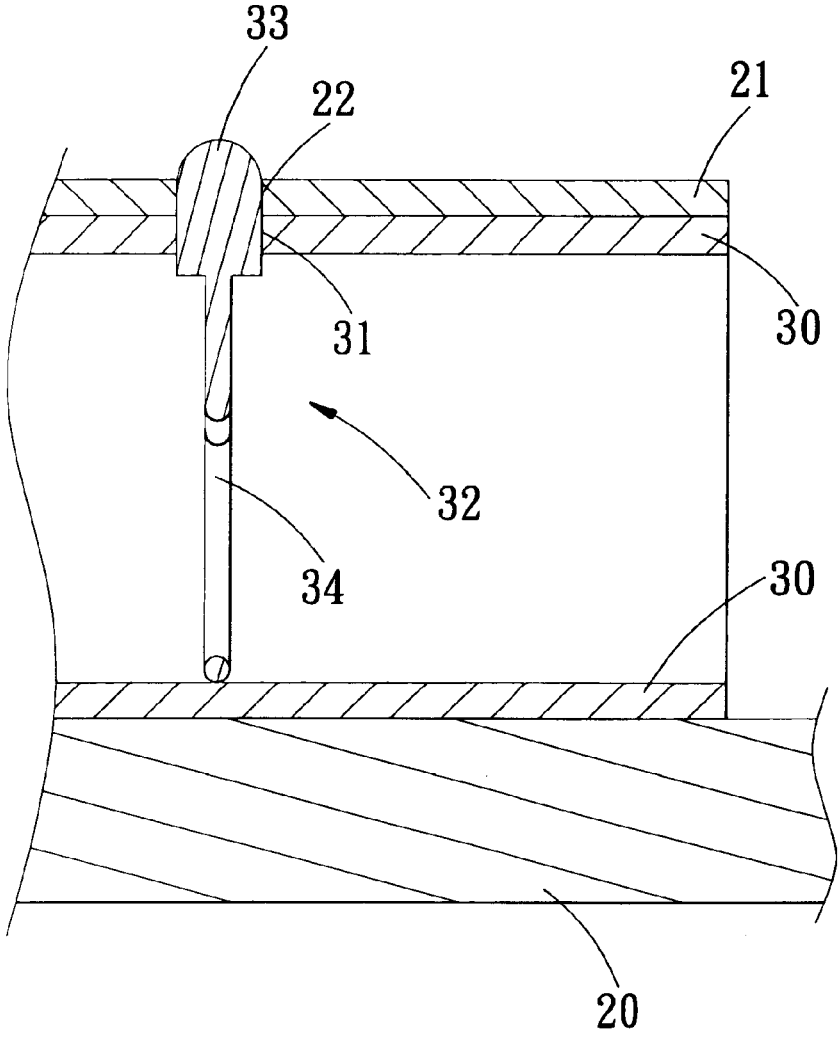
FIG. 3 is a plan cross-sectional view of the advertising ceiling fan taken along line 3—3 as shown in FIG. 2.
Figure 4:
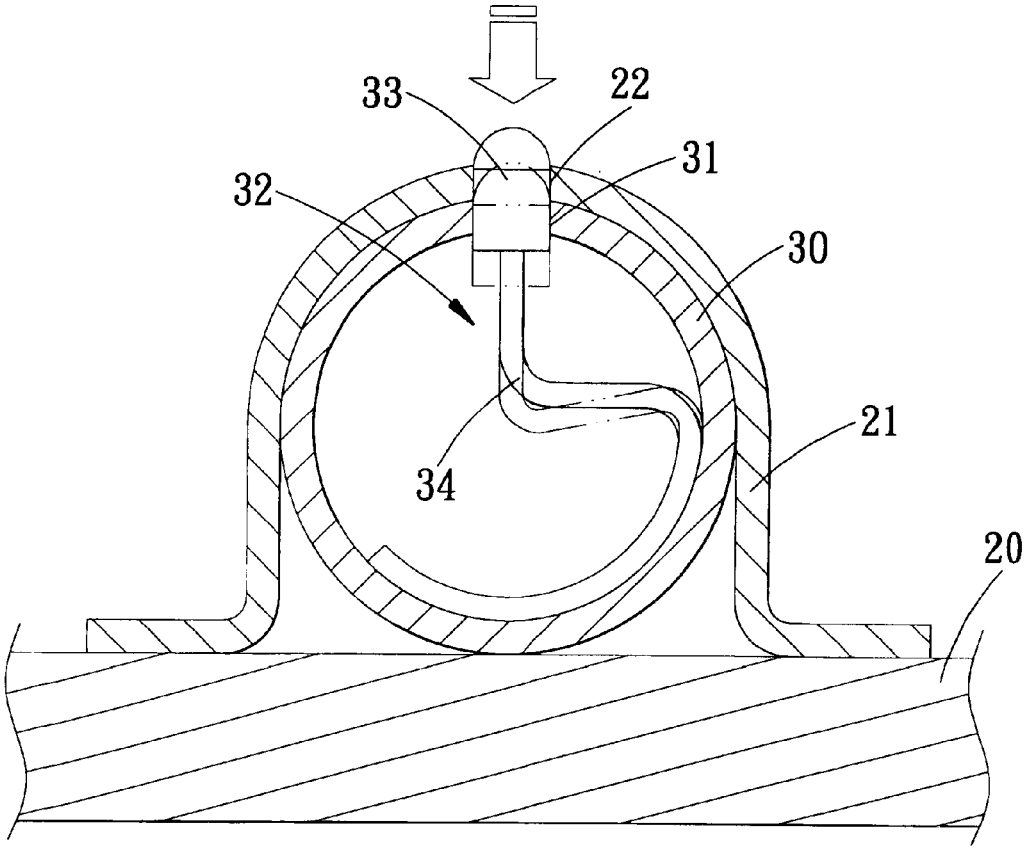
FIG. 4 is a plan cross-sectional view of the advertising ceiling fan taken along line 4—4 as shown in FIG. 2.
Figure 5:
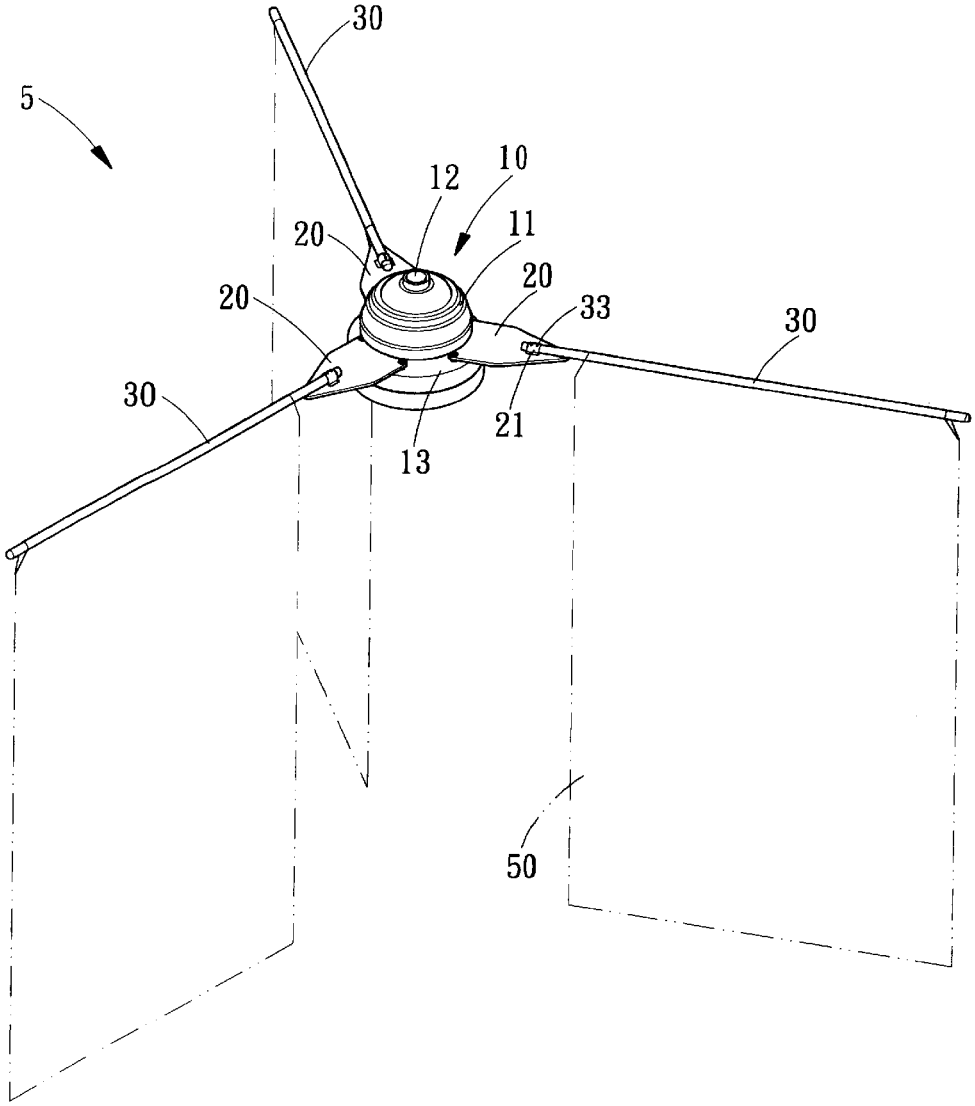
FIG. 5 is a perspective assembly view showing the use of the advertising ceiling fan in accordance with the first embodiment of the present invention.

In practice, referring to FIGS. 3–5 with reference to FIGS. 1 and 2, advertising paper 50 is hung on each of the three support tubes 30 as shown in FIG. 5, thereby providing an advertising effect. When the protruding stub 33 of each of the two elastic members 32 is pressed inward to detach from the respective through hole 22 of the semi-circular sleeve 21, the first end of the support tube 30 is detached from the semi-circular sleeve 21 of the respective blade support bracket 20 for replacement of the advertising paper 50. Then, after replacement of the advertising paper 50, the first end of the support tube 30 together with the two elastic members 32 is inserted into the semi-circular sleeve 21 of the respective blade support bracket 20 until the protruding stub 33 of each of the two elastic members 32 aligns with the respective through hole 22 of the semi-circular sleeve 21. Then, the protruding stub 33 of each of the two elastic members 32 is inserted into and locked in the respective through hole 22 of the semi-circular sleeve 21 by the restoring force of each of the two elastic members 32, so that the first end of the support tube 30 is secured to the semi-circular sleeve 21 of the respective blade support bracket 20.

Accordingly, the support tube 30 is mounted on and detached from the respective blade support bracket 20 easily and conveniently, thereby facilitating quick replacement of the advertising paper 50.

Figure 6:
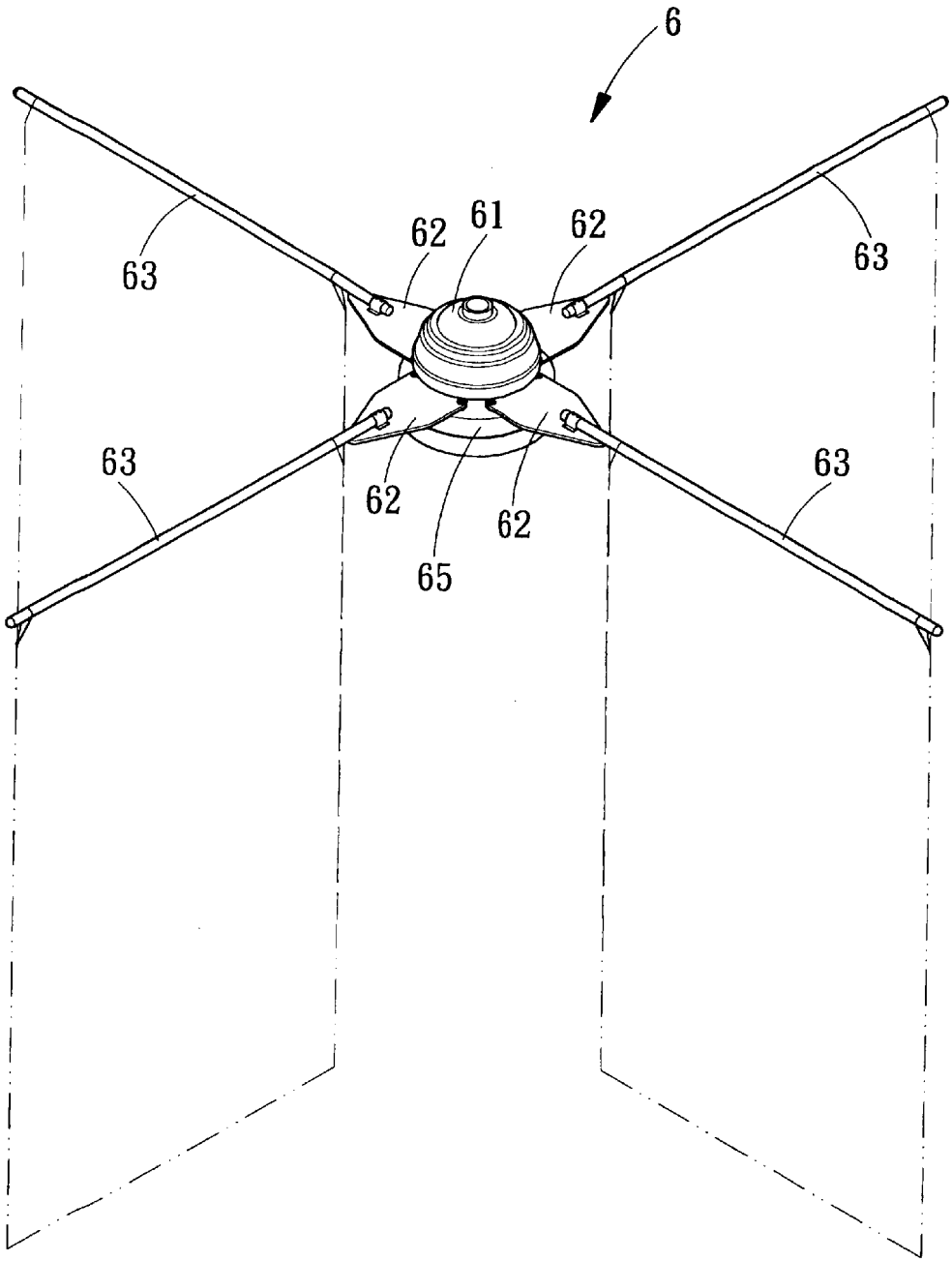
FIG. 6 is a perspective assembly view of the advertising ceiling fan in accordance with the second embodiment of the present invention.

Referring to FIG. 6, an advertising ceiling fan 6 in accordance with the second embodiment of the present invention comprises a motor seat 61, four blade support brackets 62 each secured on the periphery of the rotation disk 65 of the motor seat 61 to rotate therewith, and four support tubes 63 each secured on a respective one of the blade support brackets 62.

Figure 7:
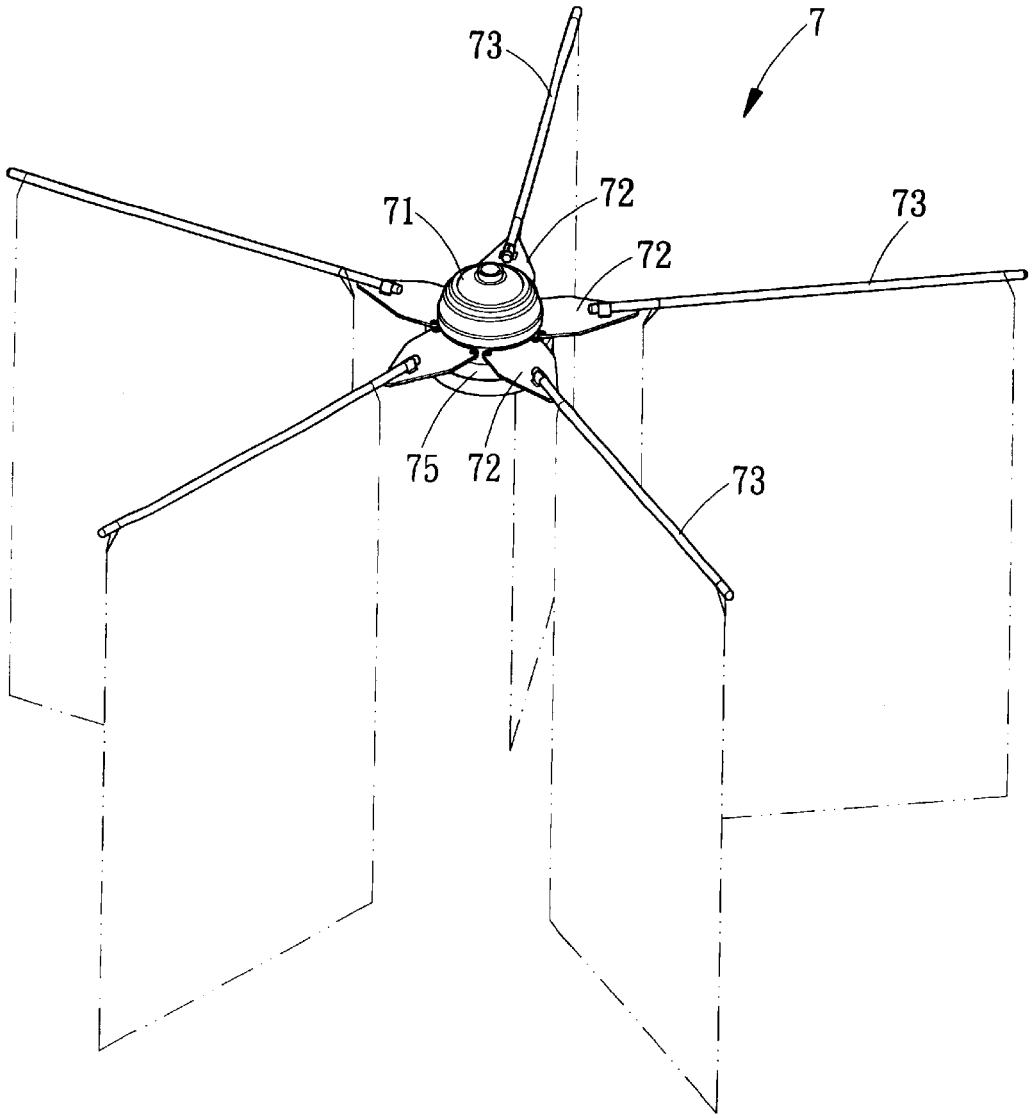
FIG. 7 is a perspective assembly view of the advertising ceiling fan in accordance with the third embodiment of the present invention.

Referring to FIG. 7, an advertising ceiling fan 7 in accordance with the second embodiment of the present invention comprises a motor seat 71, five blade support brackets 72 each secured on the periphery of the rotation disk 75 of the motor seat 71 to rotate therewith, and five support tubes 73 each secured on a respective one of the blade support brackets 72.

While the preferred embodiment(s) of the present invention has been shown and described, it will be apparent to those skilled in the art that various modifications may be made in the embodiment(s) without departing from the spirit of the present invention. Such modifications are all within the scope of the present invention.

What is claimed is:

1. An advertising ceiling fan, comprising a motor seat, a plurality of blade support brackets, and a plurality of support tubes, wherein:

the motor seat includes a protruding hood having a top having a center formed with a shaft hole, and a rotation disk rotatably mounted on a bottom of the protruding hood;

each of the blade support brackets has a first end secured on a periphery of the rotation disk of the motor seat, each of the blade support brackets is secured with a sleeve which is formed with two through holes; and each of the support tubes is secured on the sleeve of a respective one of the blade support brackets, and has one end formed with two positioning holes each aligning with a respective through hole of the sleeve, each of the support tubes includes two elastic members each mounted in the first end thereof and each having a first end formed with a protruding stub extended through a respective one of the two positioning holes of the support tube and a respective one of the two through holes of the sleeve.

2. The advertising ceiling fan in accordance with claim 1, wherein each of the blade support brackets has a second end having a triangular flat shape.

3. The advertising ceiling fan in accordance with claim 1, wherein the sleeve has a semi-circular shape.

4. The advertising ceiling fan in accordance with claim 1, wherein each of the two elastic members has a second end formed with a semi-circular pressing portion urged on a periphery of the inner wall of the support tube.

5. The advertising ceiling fan in accordance with claim 1, wherein the advertising ceiling fan comprises three blade support brackets and three support tubes.

6. The advertising ceiling fan in accordance with claim 1, wherein the advertising ceiling fan comprises four blade support brackets and four support tubes.

7. The advertising ceiling fan in accordance with claim 1, wherein the advertising ceiling fan comprises five blade support brackets and five support tubes.

* * * * *